US010828927B2

(12) United States Patent
Kuriyama

(10) Patent No.: US 10,828,927 B2
(45) Date of Patent: Nov. 10, 2020

(54) FILE

(71) Applicant: KING JIM CO., LTD., Tokyo (JP)

(72) Inventor: Tomoyuki Kuriyama, Tokyo (JP)

(73) Assignee: KING JIM CO., LTD., Tokyo (JP)

( * ) Notice: Subject to any disclaimer, the term of this patent is extended or adjusted under 35 U.S.C. 154(b) by 0 days.

(21) Appl. No.: 16/325,159

(22) PCT Filed: Apr. 17, 2018

(86) PCT No.: PCT/JP2018/015841
§ 371 (c)(1),
(2) Date: Feb. 12, 2019

(87) PCT Pub. No.: WO2018/194053
PCT Pub. Date: Oct. 25, 2018

(65) Prior Publication Data

US 2019/0168531 A1 Jun. 6, 2019

(30) Foreign Application Priority Data

Apr. 18, 2017 (JP) ..... 2017-081970

(51) Int. Cl.
*B42F 7/02* (2006.01)
*B42F 13/00* (2006.01)
(Continued)

(52) U.S. Cl.
CPC ..... *B42F 7/02* (2013.01); *B42F 7/00* (2013.01); *B42F 11/02* (2013.01); *B42F 13/00* (2013.01); *B42P 2241/04* (2013.01)

(58) Field of Classification Search
CPC .... B42F 7/02; B42F 7/00; B42F 11/02; B42P 2241/04
(Continued)

(56) References Cited

U.S. PATENT DOCUMENTS 4,470,620 A * 9/1984 Gerch ..... B42F 7/06 281/29
2016/0243878 A1 8/2016 Loree et al.

FOREIGN PATENT DOCUMENTS

CN 205344190 U 6/2016
JP S5325424 U 3/1978
(Continued)

OTHER PUBLICATIONS

International Search Report and Written Opinion issued for Application No. PCT/JP2018/015841 dated Jun. 26, 2018.
(Continued)

*Primary Examiner* — Justin V Lewis
(74) *Attorney, Agent, or Firm* — Troutman Pepper Hamilton Sanders LLP

(57) ABSTRACT

A file includes a cover body and a pocket body attached to the cover body. The cover body includes a front cover section, a spine section, and a back cover section. The front cover section and the back cover section are rotatable relative to each other about the spine section via a hinge part so as to face each other. The pocket body includes a storage part arranged to extend from the front cover section to the back cover section and allowing storage of an item to be stored. A fixed part is provided on an external side of the storage part in a plan view and fixed to the cover body. The pocket body is bendable together with the cover body while the stored item is in the pocket body.

3 Claims, 4 Drawing Sheets

(51) Int. Cl.
*B42F 7/00* (2006.01)
*B42F 11/02* (2006.01)

(58) Field of Classification Search
USPC ..... 281/3.1, 15.1, 45; 283/61, 63.1, 64; 40/359, 388, 405
See application file for complete search history.

(56) References Cited

FOREIGN PATENT DOCUMENTS

| | | | |
|---|---|---|---|
| JP | 59-19377 | U | 2/1984 |
| JP | S5919375 | U | 2/1984 |
| JP | H05177970 | A | 7/1993 |
| JP | 2004216595 | A | 8/2004 |
| JP | 3144426 | U | 8/2008 |

OTHER PUBLICATIONS

Office Action and Search Report issued in corresponding Chinese Patent Application No. 201880004208.7 dated Jul. 15, 2020 (submitted in Chinese only).

* cited by examiner

FILE

CROSS-REFERENCE TO RELATED APPLICATIONS

This Application is a National Stage of International Application PCT/JP2018/015841 filed Apr. 17, 2018, which claims priority to Japanese Application No. 2017-081970 filed Apr. 18, 2017. The above applications are incorporated herein by reference in their entirety.

TECHNICAL FIELD

The present invention relates to a file with a pocket body for storing an item to be stored such as a document attached to a cover body.

BACKGROUND

As described in Japanese Laid-open Patent Publication No. 5-177970 or Japanese Laid-open Patent Publication No. 2004-216595, for example, according to a conventionally known configuration of a file of the foregoing type, a pocket made of a synthetic resin thin sheet is joined by thermal welding or ultrasonic welding to a synthetic resin cover body.

The pocket of such a file is formed like a bag having a rectangular shape with one lateral edge portion forming an opening part without being joined to the cover body, and the other lateral edges joined to the cover body.

According to the inventions described in the above references, a substantially central part of one bag body in a horizontal direction is welded to the cover body along the substantially entire length of the bag body in a vertical direction to form two pocket parts adjacent to each other across the welded part.

In addition, the width of one of the pocket parts (a distance between the welded part and a lateral edge at a position facing the welded part) is determined to be slightly larger than the width of an item assumed to be stored. Further, while the cover body is folded, specifically, while the file is closed, the width of the cover body is determined to be slightly larger than the width of the one pocket part.

Here, one purpose of using the file is to protect an item to be stored from external force with the cover body. In consideration of the performance of such protection, the width of the cover body is preferably larger than the width of the one pocket part or that of an item to be stored in the configurations of the above noted prior art. However, the file with this configuration is to have an area larger than the area of an item to be stored even while the file is closed.

Additionally, if a user is to carry the file stored in a bag, for example, the bag is required to have a size allowing storage of the file. This means that such a file does not have high convenience due to the size of the file.

Regarding the configurations of the above noted prior art, if the file with a stored item in the pocket part is unintentionally carried so as to point the opening part downward, the stored item naturally drops down from the opening part of the pocket part. Hence, a user is required to pay attention to the direction of the file being carried.

Thus, a file having favorable convenience is desired from viewpoints of a size and a state of use.

The present invention has been made in view of the foregoing issues, and is intended to provide a file having favorable convenience.

SUMMARY

The present invention is intended for a file including a cover body and a pocket body attached to the cover body. The cover body includes a first cover section and a second cover section, and the first cover section and the second cover section are rotatable relative to each other so as to face each other. The pocket body includes a storage part arranged to extend from the first cover section to the second cover section and allowing storage of an item to be stored, an opening part for putting the item to be stored into the storage part and taking out the stored item from the storage part, and a fixed part located on an external side of the storage part in a plan view and fixed to the cover body.

The storage part is substantially rectangular. The fixed part is provided on at least one side of the storage part and fixed to at least one of the first cover section and the second cover section.

The storage part is substantially rectangular. The fixed part is provided on at least one side of the storage part and fixed to one of the first cover section and the second cover section. The other cover section includes a covering unit covering the pocket body at least partially. The covering unit includes a first wall part provided to stand upright from the other cover section, and a second wall part extending from the first wall part in a direction crossing the first wall part.

The covering unit is provided at each of opposite end portions of the other cover section perpendicular to an end portion of the other cover section contacting an adjacent cover section.

The cover body includes a spine section provided between the first cover section and the second cover section and connected to the first cover section and the second cover section via a hinge part.

The cover body includes a spine section located between the first cover section and the second cover section. The spine section includes a hinge part. The first cover section and the second cover section are rotatable relative to each other about the spine section via the hinge part.

The first cover section and the second cover section are rotatable relative to each other from an end portion of the first cover section on one side and from an end portion of the second cover section on an opposite side in the width direction of the cover body so as to make an end portion of the first cover section on the opposite side and an end portion of the second cover section on the one side get closer to or away from each other.

According to the present invention, the storage part of the pocket body is arranged to extend from the first cover section to the second cover section. Thus, the cover body can be bent so as to make the first cover section and the second cover section face each other while the stored item is in the pocket body. As a result, convenience can be increased.

Specifically, the cover body is bent so as to make the first cover section and the second cover section face each other. By doing so, the pocket body is bent to be housed between the first cover section and the second cover section. This allows size reduction of the stored item. As a result, a file having a smaller area than the area of the item to be stored can be provided.

Additionally, the stored item is in the pocket body in a state of being bent to conform to the bending of the pocket body. In this state, the stored item and the pocket body keep contacting each other at their bent positions or at peripheries of the bent positions. This increases the force of friction between the stored item and the pocket body. Thus, the stored item is unlikely to drop down from the opening part, so that the stored item can be housed reliably in the file.

DETAILED DESCRIPTION

Figure 1:
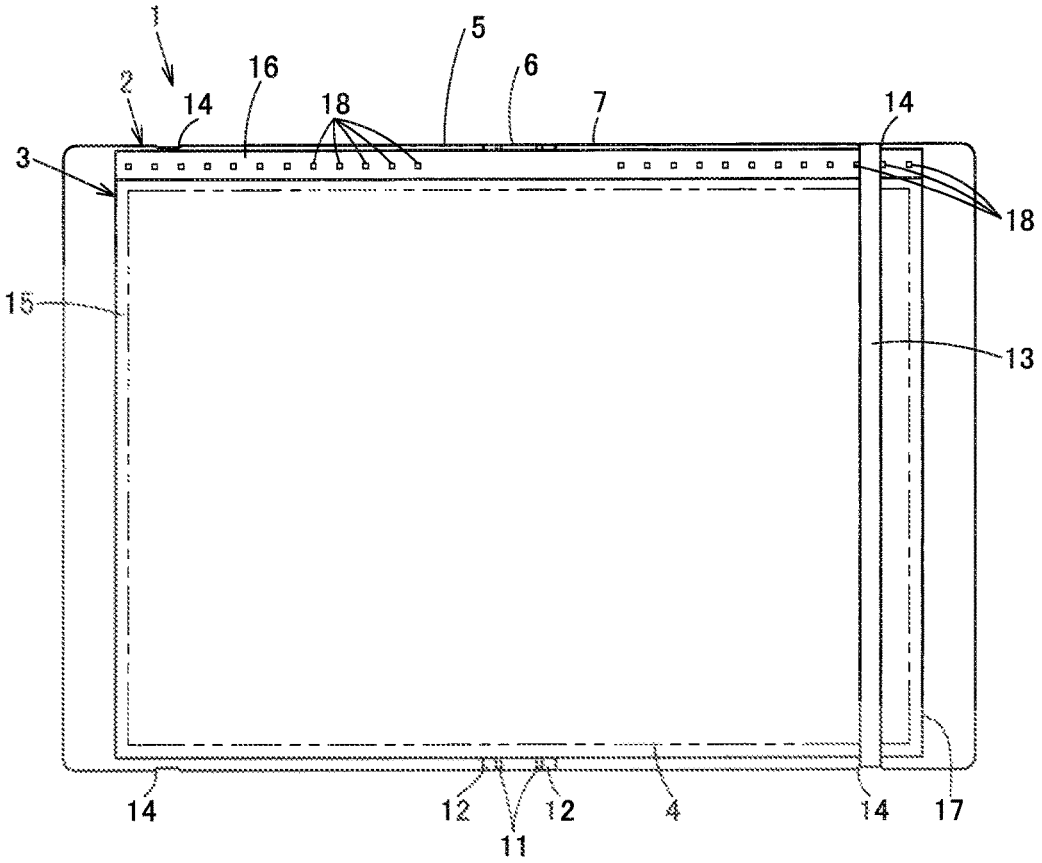
FIG. 1 is a front view showing the configuration of a file according to a first embodiment of the present invention.

A configuration of a first embodiment of the present invention will be described below in detail by referring to the drawings. In the following description, a vertical direction in FIG. 1 corresponds to a "vertical direction of a file." Likewise, a horizontal direction in FIG. 1 corresponds to a "horizontal direction of the file," and a length in the horizontal direction corresponds to a "width."

In FIG. 1, 1 is a file. The file 1 includes a pocket body 3 welded and attached by a method such as thermal welding or ultrasonic welding to an inner side surface as one surface of a cover body 2. An item 4 to be stored such as a document can be stored in the pocket body 3.

The cover body 2 includes a front cover section 5 as a first cover section, a spine section 6, and a back cover section 7 as a second cover section arranged in succession in the horizontal direction. All of the front cover section 5, the spine section 6, and the back cover section 7 are made of synthetic resin or paper, for example. For example, in one configuration, all of the front cover section 5, the spine section 6, and the back cover section 7 may be made of the same material. Further, in one configuration, all of the front cover section 5, the spine section 6, and the back cover section 7 may be made of different materials. Still further, in one configuration, the front cover section 5 and the back cover section 7 may be made of a material different from a material for the spine section 6. In this way, the respective materials are appropriately selectable.

The front cover section 5 and the back cover section 7 are substantially rectangular. The spine section 6 is joined to an end portion (right end portion) along its entire length in the vertical direction on one side of the front cover section 5 in the horizontal direction, and to an end portion (left end portion) along its entire length in the vertical direction on the opposite side of the back cover section 7 in the horizontal direction.

The spine section 6 includes two hinge parts 11 separated by a predetermined width in the horizontal direction and arranged to extend in the vertical direction, and connection parts 12 provided external to the hinge parts 11 in the horizontal direction.

In addition, the connection parts 12 are welded and connected to the front cover section 5 and the back cover section 7, thereby allowing the front cover section 5 and the back cover section 7 to rotate relative to each other about the spine section 6 via the hinge parts 11 in such a manner that an end portion (left end portion) on one side of the front cover section 5 in the horizontal direction and an end portion (right end portion) on the opposite of the back cover section 7 in the horizontal direction get closer to or away from each other. Specifically, rotating at least one of the front cover section 5 and the back cover section 7 allows opening and closing of the cover body 2 in the horizontal direction. By doing so, the cover body 2 can be placed in a state shown in FIG. 1 (opened state) in which the front cover section 5, the spine section 6, and the back cover section 7 are arranged on the substantially same plane, and in a state shown in FIG. 2 (closed state) in which the front cover section 5 and the back cover section 7 are arranged to face each other by making the left end portion of the front cover section 5 and the right end portion of the back cover section 7 approach each other, and the front cover section 5 and the back cover section 7 are bent from the spine section 6. The opened state is not limited to the state in which the front cover section 5, the spine section 6, and the back cover section 7 are arranged on the substantially same plane but may be any state in which the left end portion of the front cover section 5 and the right end portion of the back cover section 7 are separated in comparison to the closed state.

Additionally, the back cover section 7 is provided with string-shaped rubber 13 as a retention member for retaining the cover body 2 in the closed state.

Further, a lower end portion of the front cover section 5 and opposite end portions of the back cover section 7 in the vertical direction are each provided with a recess 14 at which the rubber 13 can be engaged.

In addition, with the cover body 2 in the closed state, the rubber 13 is extended from the back cover section 7 to the front cover section 5 while being stretched to be engaged with each recess 14. By doing so, the rubber 13 is held in the state of being arranged on an outer side surface of the front cover section 5 and an outer side surface of the back cover section 7 as opposite surfaces thereof. The rubber 13 exerts contractile force to retain the cover body 2 in the closed state.

The pocket body 3 is formed using synthetic resin, for example, into a shape like a rectangular sheet. While multiple pocket bodies 3 are stacked in a thickness direction, the pocket bodies 3 are arranged to extend from the front cover section 5 to the back cover section 7 across the spine section 6.

The pocket body 3 includes a bag-like storage part 15 allowing storage of the item 4 to be stored, and a fixed part 16 extending lengthwise in the horizontal direction and provided on an upper side as an external side of the storage part 15 in the vertical direction.

The storage part 15 has a shape like a bag having a right end portion provided with an opening part 17 extending along the entire length thereof in the vertical direction, closed opposite end portions in the vertical direction, and a closed left end portion. Specifically, in the storage part 15, the opening part 17 is provided parallel to an end portion corresponding to the right end portion of the back cover section 7 to allow the item 4 to be stored to be put into the storage part 15 and to allow the stored item 4 to be taken out from the storage part 15 in the horizontal direction.

The fixed part 16 is provided at an upper end portion of the pocket body 3 and above the storage part 15 to extend along the entire length of the storage part 15 in the horizontal direction.

The configuration of the pocket body 3 will be described in detail. While a single synthetic resin rectangular sheet for the pocket body 3 is folded into halves, for example, upper end portions on the opposite side to the folded position (lower end portion) in the vertical direction are welded to each other. Left end portions are further welded to each other, thereby forming the storage part 15 having a rectangular bag-like shape in a plan view with the right end portion where the opening part 17 is arranged, and the other closed end portions. Further, the two stacked sheets are welded to each other so as to form an elongated shape in the horizontal direction above the upper end portion of the storage part 15 corresponding to one side thereof along the entire length of the storage part 15 in the horizontal direction. By doing so, the sheet-like fixed part 16 is formed.

In addition, while the multiple pocket bodies 3 are stacked, for example, the fixed part 16 is welded intermittently so as to forma line in the horizontal direction. By doing so, a welded part 18 is welded to the front cover section 5 and the back cover section 7 to attach each of the pocket bodies 3 to the cover body 2.

It is noted that as long as the storage part 15 is formed into a bag-like shape closed at two or more end portions, the pocket body 3 is not limited to the configuration where the opening part 17 is provided at the right end portion. The pocket body 3 may also be configured in such a manner that the opening part 17 is provided at the upper end portion, left end portion, or lower end portion of the storage part 15 near the fixed part 16.

The operation and effect of the foregoing first embodiment will be described next.

FIG. 1 shows a state in which the stored item 4 is stored in the storage part 15 of the file 1 while the cover body 2 is opened.

For storing the item 4 to be stored in the file 1 and carrying the file 1, the front cover section 5, the spine section 6, and the back cover section 7 are first arranged on the substantially same plane to place the cover body 2 in the opened state. In this state, the item 4 to be stored is inserted into the storage part 15 through the opening part 17, thereby storing the item 4 to be stored in the storage part 15.

Figure 2:
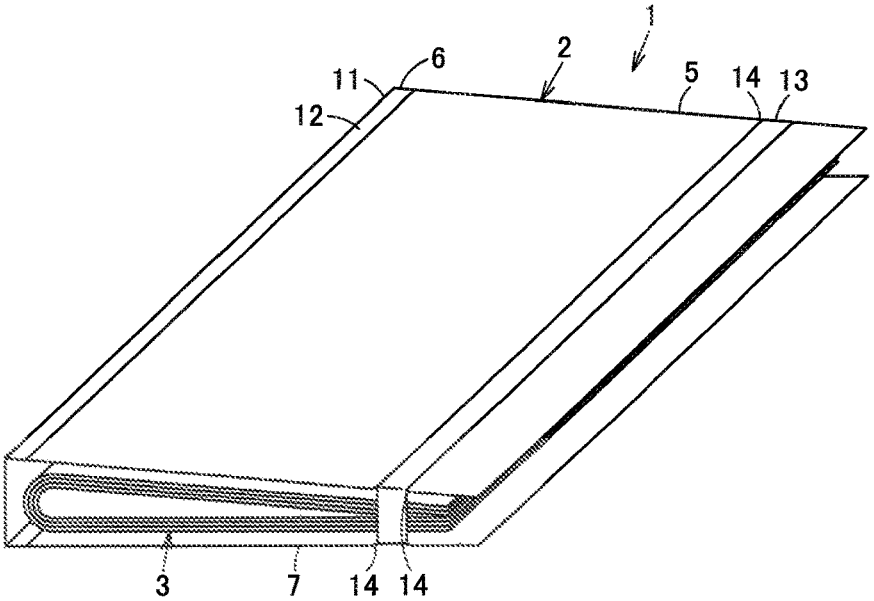
FIG. 2 is a perspective view showing the file in a closed state.

Next, while the cover body 2 is opened, the front cover section 5 and the back cover section 7 of the cover body 2 are rotated relative to each other about the spine section 6 via the hinge parts 11 so as to make the left end portion of the front cover section 5 and the right end portion of the back cover section 7 get closer to each other. By doing so, the pocket body 3 is bent while the stored item 4 is in the storage part 15, and the cover body 2 is placed in the closed state with the front cover section 5 and the back cover section 7 facing each other, as shown in FIG. 2.

Further, the rubber 13 is extended from the back cover section 7 to the front cover section 5. This makes the rubber 13 exert contractile force to retain the cover body 2 in the closed state. Then, the file 1 is stored in a bag, for example, and carried.

Additionally, in the foregoing file 1, the storage part 15 of the pocket body 3 is arranged to extend from the front cover section 5 to the back cover section 7. This allows the pocket body 3 with the stored item 4 therein to be bent together with the cover body 2. Thus, the stored item 4 and the pocket body 3 with the stored item 4 therein in the bent state are housed between the front cover section 5 and the back cover section 7. As a result, the file 1 itself can become compact in a plan view compared to the area of the item 4 to be stored in a normal state, making it possible to increase convenience from a viewpoint of a size.

Further, as a result of bending the pocket body 3 in the foregoing manner together with the cover body 2, the stored item 4 in the pocket body 3 receives frictional force larger than the force of friction with the storage part 15 acting when the stored item 4 is in a normally stored state. Thus, even if a user of the file 1 holds the file 1 in the closed state so as to place the opening part 17 of the pocket body 3 at a lower position, the stored item 4 is still unlikely to drop down from the storage part 15. Specifically, even if no consideration is given to the position or direction of the opening part 17 in a state of use, the stored item 4 is still unlikely to drop down unexpectedly from the opening part 17. In this way, convenience from a viewpoint of a state of use can be increased.

In particular, the cover body 2 is openable and closable in the horizontal direction, and the opening part 17 of the pocket body 3 is provided at the end portion of the storage part 15 in the horizontal direction. In this configuration, even if the stored item 4 receives force generated by pointing the opening part 17 downward, for example, and acting to make the stored item 4 drop down from the opening part 17, frictional force is still increased by the bending of the pocket body 3 and the stored item 4 in a direction substantially vertical to the direction of this force. This makes it possible to prevent an unexpected drop of the stored item 4 more reliably.

Also, the spine section 6 having a predetermined width is provided between the front cover section 5 and the back cover section 7, and the front cover section 5 and the back cover section 7 are rotatable relative to each other via the hinge parts 11 at the spine section 6. In this configuration, space responsive to the width of the spine section 6 can be ensured inside the cover body 2 while the file 1 is closed. Thus, bending of the cover body 2 is unlikely to cause a crease, etc. on the stored item 4 in the pocket body 3 in the cover body 2.

In the configuration of the foregoing first embodiment, the spine section 6 with the hinge parts 11 is provided between the front cover section 5 and the back cover section 7. However, this is not a limited configuration. For example, in one configuration, the spine section 6 may be omitted, and the front cover section 5 and the back cover section 7 may be rotatably connected directly. In an alternative configuration, the front cover section 5 and the back cover section 7 may be connected with rings, for example.

The shapes of the cover body 2 and the pocket body 3 are not limited to rectangles but can be designed appropriately.

The cover body 2 and the pocket body 3 are not limited to the configuration of being fixed to each other by welding. The pocket body 3 may be fixed to the cover body 2 by an appropriate method such as sewing or welding.

In addition, in the foregoing configuration of the cover body 2, the rubber 13 as the retention member is provided at the cover body 2, and the front cover section 5 and the back cover section 7 are each provided with the recess 14 at which the retention member can be engaged. However, this is not a limited configuration. A configuration with the rubber 13 and without the recess 14 is applicable. A configuration without the rubber 13 and without the recess 14, specifically, a configuration without the retention member, is also applicable.

Also, the configuration with the retention member is not limited to the configuration where the rubber 13 is provided as the retention member. Any retention member capable of retaining the cover body 2 in the closed state is applicable.

The pocket body 3 is not limited to the configuration of being made of a single synthetic resin sheet. As long as the pocket body 3 is configured to include the storage part 15 capable of storing the item 4 to be stored and the fixed part 16 fixed to the cover body 2, the arrangements or methods of forming the storage part 15 and the fixed part 16 can be changed appropriately.

The opening part 17 is not limited to the configuration of being provided at the right end portion of the storage part 15 and substantially parallel to this right end portion. Any configuration allowing the item 4 to be stored to be put into the storage part 15 and allowing the stored item 4 to be taken out from the storage part 15 is applicable to the opening part 17. More specifically, in one configuration, the opening part 17 may be provided at one of the end portions of the storage part 15 in the vertical direction to be substantially vertical to the end portions of the storage part 15 in the horizontal direction, for example.

The fixed part 16 is not limited to the configuration of being arranged above the storage part 15. The fixed part 16 is only required to be arranged on an external side of the storage part 15 (an external side in the vertical direction or an external side in the horizontal direction).

Additionally, the fixed part 16 is not limited to the configuration of being fixed to both the front cover section 5 and the back cover section 7. The fixed part 16 is only required to be fixed to at least one of the front cover section 5 and the back cover section 7. For example, like in a second embodiment described below, the fixed part 16 may be configured to be fixed only to the back cover section 7.

Figure 3:
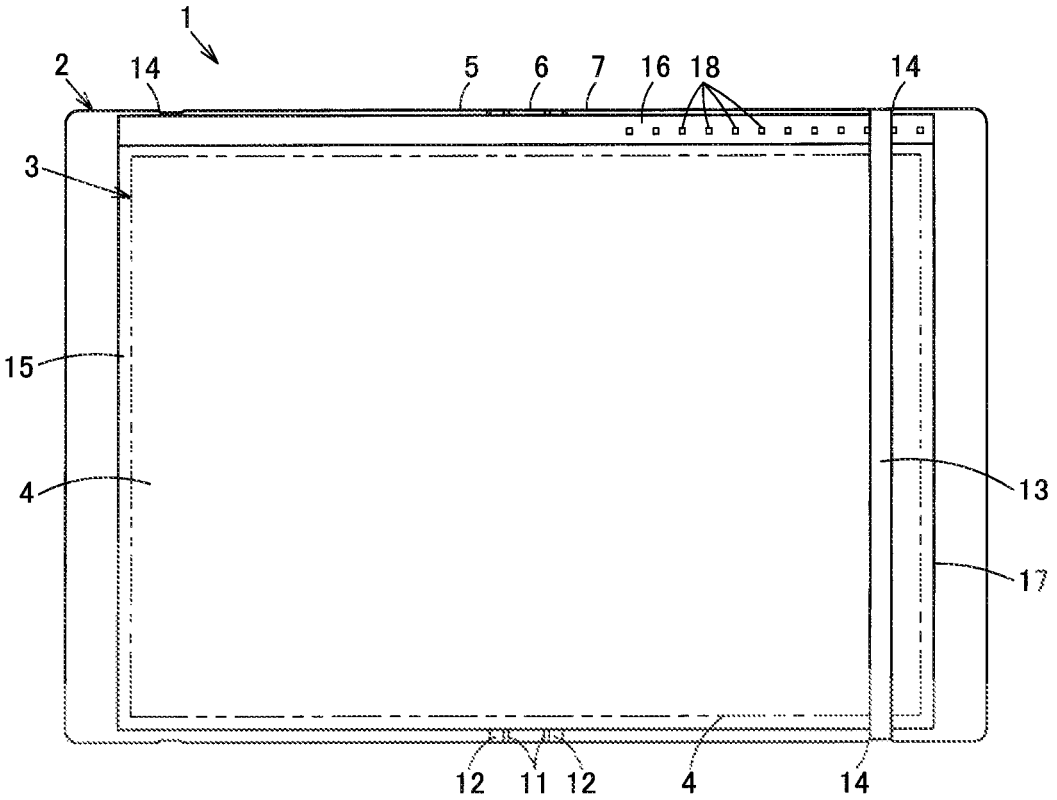
FIG. 3 is a front view showing the configuration of a file according to a second embodiment of the present invention.
Figure 4:
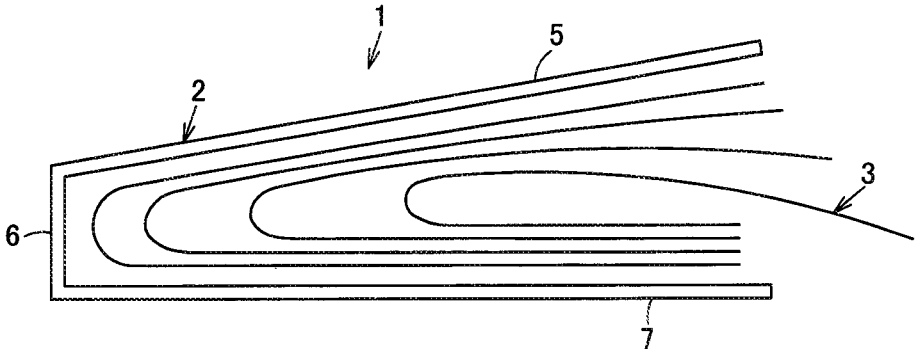
FIG. 4 is a schematic view showing a lower end portion of each pocket body while the file of the first embodiment of the present invention is closed.

The second embodiment will be descried by referring to FIGS. 3 and 4. A configuration and operation comparable to those in the foregoing first embodiment will be given signs in the same way and will not be described.

As shown in FIG. 3, according to the second embodiment, the fixed part 16 of the pocket body 3 is not fixed to the front cover section 5 but is fixed only to the back cover section 7, compared to the file of the foregoing first embodiment. Specifically, in the pocket body 3, the welded part 18 of the fixed part 16 is formed only on the part of the back cover section 7.

Here, it is assumed, for example, that multiple stacked pocket bodies 3 are fixed to both the front cover section 5 and the back cover section 7 like in the foregoing first embodiment. In this case, if the cover body 2 is folded to bend the pocket bodies 3, a difference in a bent form is generated between a pocket body 3 in a bottom layer nearest the cover body 2 and a pocket body 3 in a top layer farthest from the cover body 2. Specifically, after the bending, the pocket body 3 in the bottom layer is located in an outermost periphery, whereas the pocket body 3 in the top layer is located in an innermost periphery of a shorter range than the pocket body 3 in the outermost periphery. Unless the length of the fixed part 16 of each pocket body 3 is increased or reduced, the position of one pocket body 3 adjacent to the cover body 2 and that of a different pocket body 3 adjacent to the one pocket body 3 relative to each other at their fixed parts 16 and their vicinities are to change between the state before the bending and the state after the bending. However, if the one pocket body 3 is fixed so as to be prohibited from moving relative to the different adjacent pocket body 3, the foregoing change in the relative positions is restricted. This causes instability of the position of a lower end portion of each pocket body 3 opposite to the fixed part 16 while the file 1 is closed as shown in FIG. 4. This instability causes the probability of difficulty in retaining the cover body 2 in the closed state and the probability that a part of the pocket body 3 will unfortunately go out of the cover body 2.

In this regard, like in the second embodiment, the welded part 18 of the fixed part 16 is formed only on the part of the back cover section 7 to fix the fixed part 16 only to the back cover section 7. In this configuration, change in the position of each pocket body 3 relative to the cover body 2 responsive to opening and closing of the file is allowed only on the part of the front cover section 5. This makes it unlikely that the position of the lower end portion of each pocket body 3 will become unstable even while the file is closed. Thus, the file 1 is easily retained in the closed state by bending the cover body 2 and the pocket body 3.

In the configuration where the pocket body 3 is joined to the back cover section 7 and is not joined to the front cover section 5, during the motion of closing the file 1, for example, each of the stacked pocket bodies 3 is displaced so as to make sliding motion in response to the stacked position of this pocket body 3 relative to the front cover section 5 while retaining its position relative to the back cover section 7. In this way, the relative position of each pocket body 3 is adjusted, making it possible to reduce the likelihood of instability occurring at the respective positions of the lower end portions of the pocket bodies 3.

In the foregoing configuration, however, each pocket body 3 is in the state of merely being placed over the front cover section 5 when a user is to use the file 1 in the opened state. Hence, each pocket body 3 may be lifted on the part of the front cover section 5 of the pocket body 3 with a finger of the user against the intention of the user to cause the risk of bending of each pocket body 3 and the stored item 4 in this pocket body 3.

In response to this, like in a third embodiment described below, the pocket body 3 may be prevented from being lifted by restricting the motion of the pocket body 3 on the part of the front cover section 5, for example.

The third embodiment will be described by referring to FIGS. 5 to 7. It is noted that a configuration and operation comparable to those in each of the foregoing embodiments will be given signs in the same way and will not be described.

Figure 5:
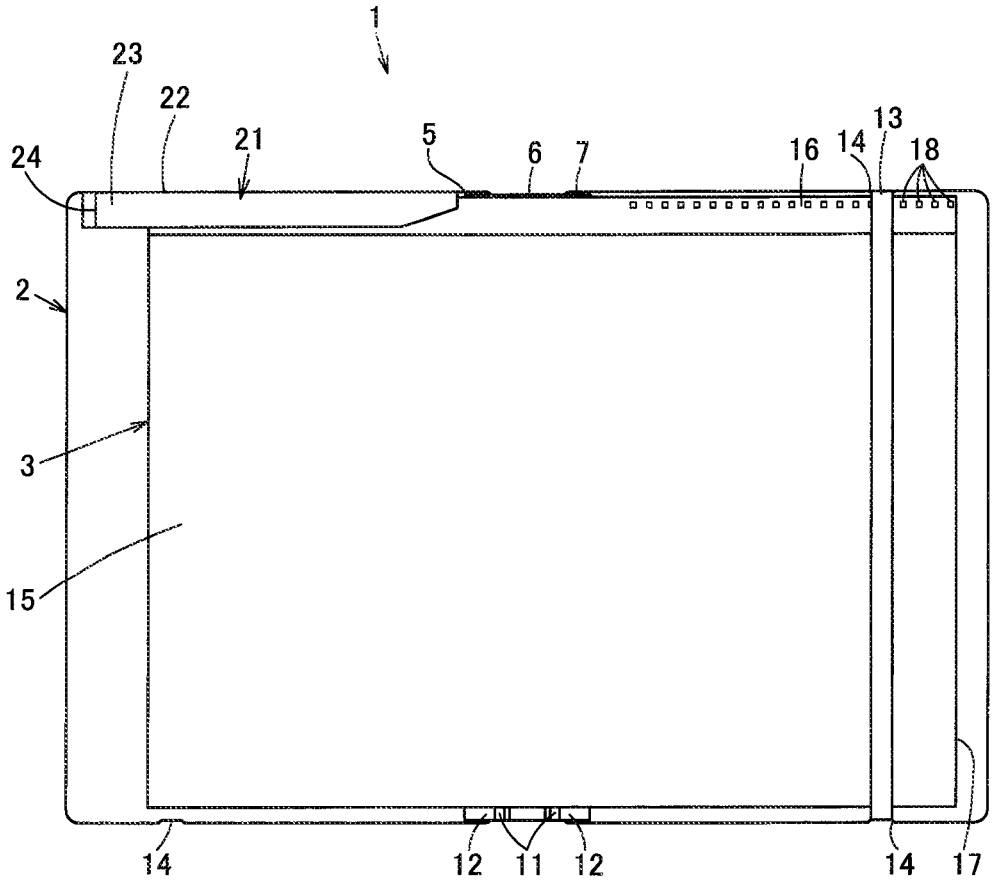
FIG. 5 is a front view showing the configuration of a file according to a third embodiment of the present invention.
Figure 6:
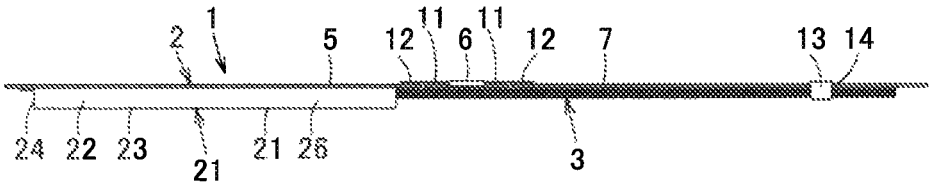
FIG. 6 is a plan view of the file according to the third embodiment.
Figure 7:
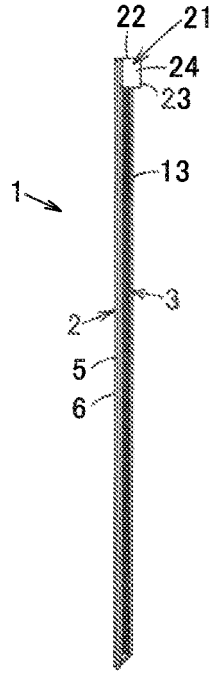
FIG. 7 is a left side view of the file according to the third embodiment.

As shown in FIGS. 5, 6, and 7, in the third embodiment, a covering unit 21 is provided to cover a position of the pocket body 3 placed on the front cover section 5 and to face the welded part 18 at the back cover section 7 when the file 1 is closed.

The covering unit 21 includes a first wall part 22 provided so as to stand upright substantially vertically from the upper end portion or its vicinity of the inner side surface as one surface of the front cover section 5 in an inward direction determined when the file 1 is closed, and a second wall part 23 provided so as to extend substantially vertically to the first wall part 22 from an end portion (tip portion) of the first wall part 22 opposite to an end portion (base portion) of the first wall part 22 contacting the front cover section 5 (substantially parallel to the front cover section 5). If necessary, the covering unit 21 may be configured to further include a third wall part 24 provided so as to form a surface extending toward the front cover section 5 from a left end portion of the first wall part 22 and a left end portion of the second wall part 23.

The foregoing configuration can prevent lift of each pocket body 3 from the front cover section 5 without restricting displacement of the pocket body 3 resulting from bending of the cover body 2.

In this case, the first wall part 22 may be provided to extend along the entire length of the upper end portion of the front cover section 5 in the horizontal direction, or may be configured to have a length less than the entire length. The second wall part 23 may be provided to extend along the entire length of the front cover section 5 in the vertical direction from the upper end portion toward the lower end portion of the front cover section 5, or may be configured to have such an area that the second wall part 23 covers only a position and its vicinity of the pocket body 3 placed on the front cover section 5 and to face the welded part 18 at the back cover section 7 when the file 1 is closed. The size of the covering unit 21 is determined by such configurations. Lift of the pocket body 3 is prevented further by the increase in the size of the covering unit 21. However, this size increase makes it more difficult to recognize a corresponding position at the pocket body 3 or the stored item 4 visually. Thus, an appropriate size may be selected in response to the size of the file 1, specifically, in response to the size of the pocket body 3 or that of the item 4 to be stored.

Further, if high strength is not required for the covering unit 21, the covering unit 21 may be configured to include only the first wall part 22 and the second wall part 23. If high strength is required, the covering unit 21 may be configured to include the third wall part 24 for reinforcement of the covering unit 21 in addition to the first wall part 22 and the second wall part 23.

Figure 8:
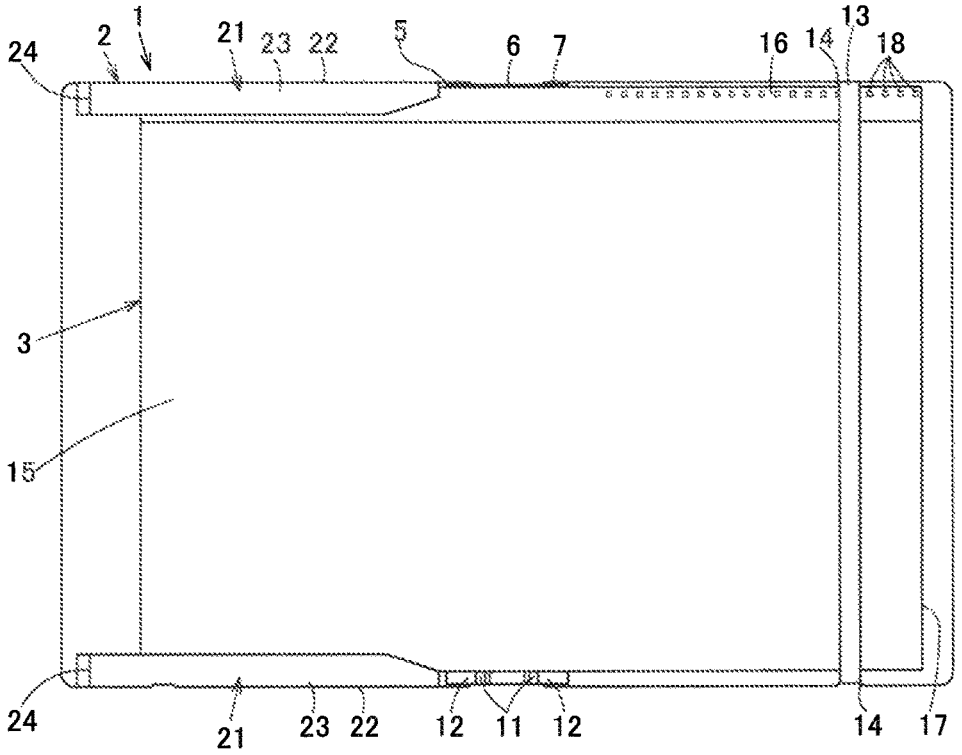
FIG. 8 is a front view showing the configuration of a file according to a fourth embodiment of the present invention.

Additionally, like in a fourth embodiment shown in FIG. 8, in the configuration with the covering unit 21, the covering unit 21 may be provided at each of the opposite end portions of the front cover section 5 in the vertical direction, specifically, at each of the opposite end portions (upper end portion and lower end portion) of the front cover section 5 perpendicular to an upper end portion of an end portion (right end portion) of the front cover section 5 contacting the spine section 6.

In this configuration, each pocket body 3 is surrounded by the covering unit 21 at the upper end portion and the covering unit 21 at the lower end portion. This can prevent each pocket body 3 from being lifted from the front cover section 5 and can restrict the motion of each pocket body 3 in the vertical direction.

The present invention is applicable to a file, etc. with a pocket body for storing an item such as a document attached to a cover body.

The invention claimed is:

1. A file comprising:

a cover body, comprising a first cover section and a second cover section, and a pocket body attached to the cover body, comprising:

a storage part arranged to extend from the first cover section to the second cover section and formed to storage an item to be stored, an opening part for putting the item to be stored into the storage part and taking out the stored item from the storage part, and a fixed part located on an external side of the storage part in a plan view and fixed to the cover body, wherein the storage part is rectangular, the fixed part is provided on at least one side of the storage part, the other cover section comprises a covering unit covering the pocket body at least partially, and the covering unit comprises a first wall part provided to stand upright from the other cover section, and a second wall part extending from the first wall part in a direction crossing the first wall part.

2. The file according to claim 1, wherein the storage part is rectangular, and the fixed part is provided on at least one side of the storage part.

3. The file according to claim 1, wherein the cover body comprises a spine section provided between the first cover section and the second cover section and connected to the first cover section and the second cover section via a hinge part.

* * * * *